US008096428B2

(12) United States Patent
Slimane

(10) Patent No.: US 8,096,428 B2
(45) Date of Patent: Jan. 17, 2012

(54) COUNTER DISPLAY FOR ARTICLES SUCH AS PERFUMES AND COSMETIC PRODUCTS

(75) Inventor: Hedi Slimane, Paris (FR)

(73) Assignee: Parfums Christian Dior, Paris (FR)

( * ) Notice: Subject to any disclaimer, the term of this patent is extended or adjusted under 35 U.S.C. 154(b) by 559 days.

(21) Appl. No.: 10/599,354

(22) PCT Filed: Mar. 25, 2005

(86) PCT No.: PCT/FR2005/000733

§ 371 (c)(1),
(2), (4) Date: Sep. 26, 2006

(87) PCT Pub. No.: WO2005/094636

PCT Pub. Date: Oct. 13, 2005

(65) Prior Publication Data

US 2007/0138117 A1 Jun. 21, 2007

(30) Foreign Application Priority Data

Mar. 30, 2004 (FR) ..... 04 03309

(51) Int. Cl.
*A47G 29/00* (2006.01)

(52) U.S. Cl. ..... 211/85.29

(58) Field of Classification Search ..... 211/85.29, 211/113, 69.5, 118, 131.1, 189, 95, 13.1, 211/85–29, 69–5, 131–1, 13–1; 132/315, 132/314; 312/245

See application file for complete search history.

(56) References Cited

U.S. PATENT DOCUMENTS

| | | | | | |
|---|---|---|---|---|---|
| 546,608 | A | * | 9/1895 | Davis et al. | 211/85.29 |
| 1,952,466 | A | | 3/1934 | Sjodin et al. | |
| 3,856,146 | A | * | 12/1974 | Levine | 211/134 |
| 4,094,030 | A | * | 6/1978 | Saad | 12/116.8 |
| 4,121,600 | A | * | 10/1978 | Riddick et al. | 132/310 |
| 4,121,720 | A | * | 10/1978 | Hayes | 211/113 |
| 4,140,222 | A | * | 2/1979 | Francavilla | 211/65 |
| 4,180,921 | A | * | 1/1980 | Elbaum et al. | 434/405 |
| 4,322,007 | A | * | 3/1982 | Feibelman | 211/163 |
| 4,334,623 | A | * | 6/1982 | Geary | 211/85.29 |
| 4,390,099 | A | * | 6/1983 | Trautlein et al. | 211/4 |
| 4,390,102 | A | * | 6/1983 | Lane | 211/85.29 |
| 4,776,650 | A | * | 10/1988 | Ferenzi | 312/245 |
| 4,815,483 | A | * | 3/1989 | DuGrenier et al. | 132/295 |

(Continued)

FOREIGN PATENT DOCUMENTS

BE 890694 4/1982

(Continued)

OTHER PUBLICATIONS

French Preliminary Search Report FR 0403309; report dated Nov. 4, 2004.

(Continued)

*Primary Examiner* — Sarah Purol

(74) *Attorney, Agent, or Firm* — Miller, Matthias & Hull LLP

(57) ABSTRACT

The inventive counter display for articles such as perfumes and cosmetic products comprises a connecting element (3) extending between a lower end (3*b*) fixed to a displaying element (2) and a top end (3*a*) pivotally mounted with respect to a ceiling (8). A mirror (6) is also arranged on the connecting element.

8 Claims, 2 Drawing Sheets

U.S. PATENT DOCUMENTS

| | | | | |
|---|---|---|---|---|
| 4,974,523 | A * | 12/1990 | Giarratana | 108/42 |
| 5,335,798 | A * | 8/1994 | Bonwell et al. | 211/65 |
| 5,553,719 | A * | 9/1996 | Campbell | 211/30 |
| D385,136 | S * | 10/1997 | Gutke | D6/524 |
| 6,010,017 | A | 1/2000 | Michaelis et al. | |
| 6,283,312 | B1 * | 9/2001 | Edgerton | 211/113 |
| 6,299,002 | B1 * | 10/2001 | Garnier | 211/162 |
| 6,336,564 | B1 * | 1/2002 | Garnier | 211/162 |
| 6,361,130 | B1 * | 3/2002 | Kardy | 312/245 |
| 6,530,488 | B1 * | 3/2003 | Krammes, Jr. | 211/85.29 |
| 6,820,755 | B1 * | 11/2004 | Ranjit | 211/70.6 |
| 7,255,313 | B2 * | 8/2007 | Lane | 248/222.41 |
| 2002/0027113 | A1 | 3/2002 | Lacout | |
| 2003/0116516 | A1 * | 6/2003 | Belokin et al. | 211/69.5 |
| 2004/0206712 | A1 | 10/2004 | Wicha et al. | |
| 2005/0236349 | A1 * | 10/2005 | Lagman et al. | 211/153 |
| 2006/0131253 | A1 * | 6/2006 | Richardson et al. | 211/189 |
| 2007/0138117 | A1 * | 6/2007 | Slimane | 211/113 |
| 2008/0023424 | A1 * | 1/2008 | Sudholt | 211/85.29 |
| 2008/0173325 | A1 * | 7/2008 | McGarry | 132/315 |

FOREIGN PATENT DOCUMENTS

| | | |
|---|---|---|
| GB | 222248 | 10/1924 |
| JP | 2001-299522 A | 10/2001 |
| JP | 2002-034741 A | 2/2002 |

OTHER PUBLICATIONS

International Search Report for International Application No. PCT/FR2005/000733; report dated Jul. 29, 2005, 3 pages.

* cited by examiner

COUNTER DISPLAY FOR ARTICLES SUCH AS PERFUMES AND COSMETIC PRODUCTS

CROSS REFERENCE TO RELATED APPLICATION

This is the U.S. National Phase of International Application No PCT/FR2005/00733, filed Mar. 25, 2005, the entire disclosure of which is incorporated by reference.

FIELD OF THE DISCLOSURE

The present invention relates to counter displays for articles such as perfumes or cosmetic products, these counter displays comprising a display element to which said articles are designed to be attached.

BACKGROUND OF THE DISCLOSURE

In a manner known per se, the display element is generally tilted downward while being secured to a base resting directly on the ground. However, generally, such counter displays are fairly bulky and it is thus necessary to reserve an area on the ground that is relatively large in order to accommodate them. Furthermore, this area on the ground has to be perfectly flat to prevent said counter display or, more precisely, its base, being in unstable positions.

An object of the present invention is, in particular, to palliate the abovementioned drawbacks.

SUMMARY OF THE DISCLOSURE

To that end, according to the invention, the counter display is characterized in that it also comprises a connecting element extending between a lower end secured to the display element and an upper end, designed so as to be pivotally mounted with respect to a ceiling forming the upper part of a piece for suspending said display element from the ceiling with no contact with the ground, and in that a mirror is attached to said connecting element, said mirror being arranged such that a person standing in front of the display element can observe his/her image in said mirror.

In preferred embodiments of the invention, it is possible, optionally, also to have recourse to one or other of the following arrangements:

- the upper end of the connecting element is designed so as to be pivotably mounted relative to the ceiling;
- the connecting element has, first, a front face to which the mirror is attached and, second, a rear, face to which a lighting system is attached;
- the connecting element comprises a vertical panel to which the mirror is attached, the vertical panel extending downward via a support panel to which the display element is attached, the support panel being tilted downward relative to the vertical panel at an angle of between 90° and 135°;
- the support panel and vertical panel of the connecting element respectively have a face tilted downward and a rear face to which lighting systems are attached, which are covered by at least one substantially translucent cover that allows diffuse lighting toward the rear and toward the bottom of said counter display;
- the connecting element comprises a vertical panel to which the mirror is attached, the vertical panel extending downward via the display element that is tilted relative to the vertical panel at an angle of between 90° and 135°;

- the vertical panel of the connecting element and the display element respectively have a rear face and a face tilted downward, to which faces lighting systems are attached, which are covered by at least one substantially translucent cover allowing diffuse lighting toward the rear and toward the bottom of said counter display;
- the cover comprises, first, a rear plate extending via a plate tilted downward and, second, transverse edges that link the rear plate and the plate tilted downward to the counter display in order, also, to allow lighting on the sides of said counter display; and
- the upper end of the connecting element is formed by a bar provided with means for attachment to the ceiling, which allow pivoting of said bar relative to the ceiling about a vertical axis.

Further characteristics and advantages of the invention will become apparent in the course of the following description of two embodiments that are given by way of nonlimiting example, with reference to the appended drawings.

BRIEF DESCRIPTION OF THE DRAWINGS

In the drawings.

In the various figures, the same references denote identical or similar elements.

DETAILED DESCRIPTION OF THE DISCLOSURE

Figure 1:
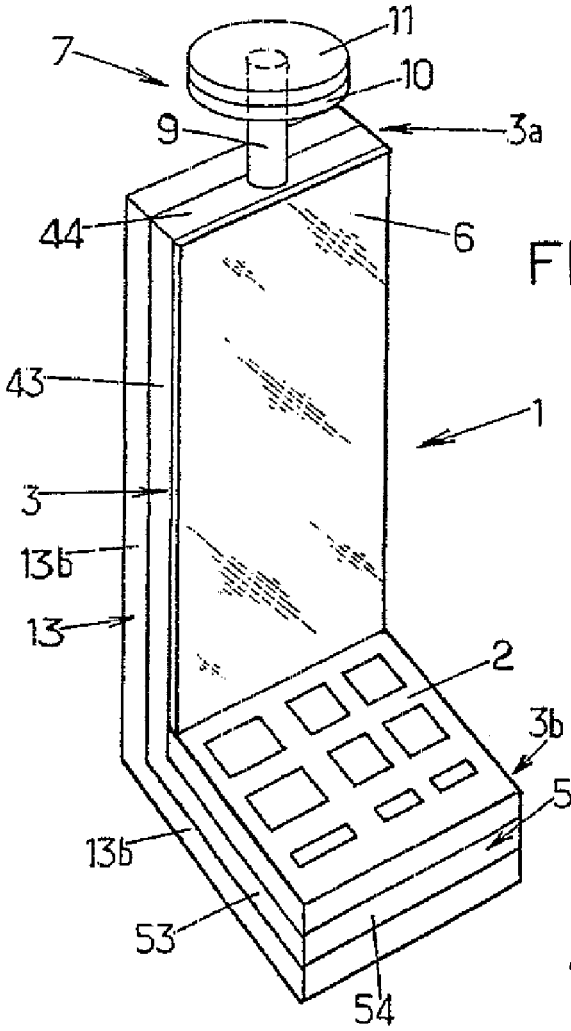
FIG. 1 shows a diagrammatic, perspective view of the counter display according to a first embodiment of the invention.
Figure 2:
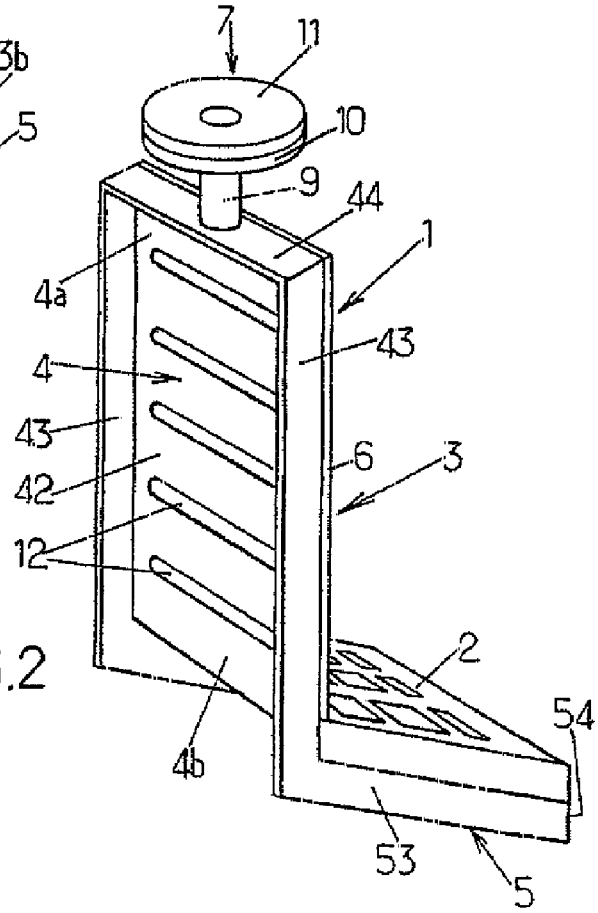
FIG. 2 is a rear, perspective view of a connecting element of the counter display shown in FIG. 1.
Figure 3:
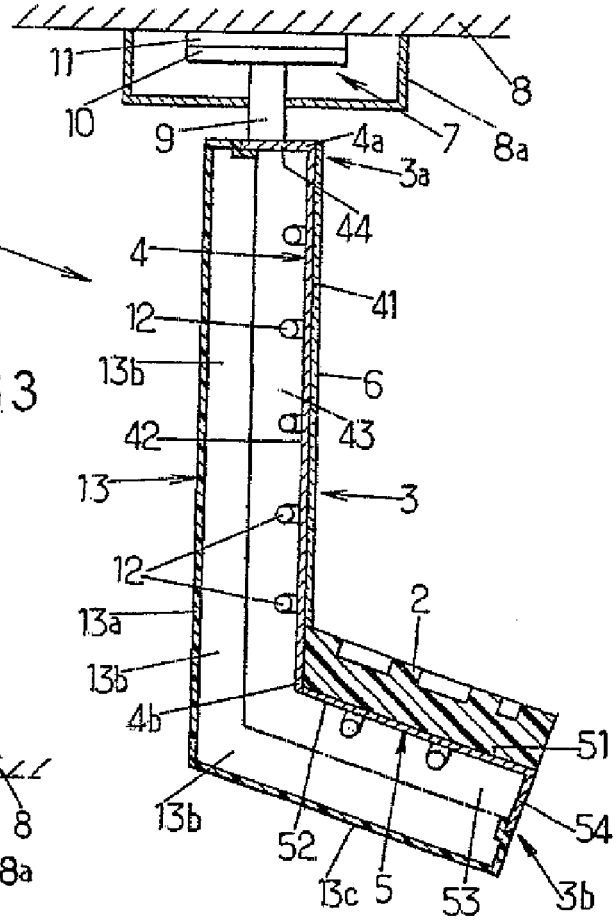
FIG. 3 is a sectional view in the plane of symmetry of the counter display shown in FIG. 1.

FIGS. 1 to 3 show a first embodiment of a counter display 1 for articles that may, in particular, consist, by way of example, of perfumes or cosmetic products.

This counter display 1 comprises a display element 2 designed to accommodate the articles to be displayed, this display element 2 being designed to be supported by a connecting element 3, itself designed to be suspended from a ceiling 8, forming the upper part of a room. This connecting element 3 extends between an upper end 3*a* secured to the ceiling 8 and a lower end 3*b* secured to the display element 2.

As may be seen in greater detail in FIGS. 2 and 3, the connecting element 3, in the example considered here, comprises a vertical panel 4 extending between an upper end 4*a* and a lower end 4*b*, which extends downward via a support panel 5 that may be produced as a single piece together with the vertical panel 4. In this first embodiment, the lower end 3*b* of the connecting element 3 is combined with the lower end of the support panel 5. The display element 2 to which the articles are designed to be attached is attached directly, in a fixed or removable manner, to the front face 51 of the support panel 5.

The vertical panel 4 has a front face 41 to which a mirror 6 is attached in a fixed manner, arranged such that a person standing in front of the display element 2 and thus facing the perfumes or cosmetic products can directly observe his or her reflection in the mirror 6. In the example considered here, with reference to FIG. 3, the mirror 6 extends over the entire height of the vertical panel 4. Thus, the vertical panel 4 fulfills two functions, allowing the display element 2 to be suspended from the ceiling while also serving as a support for the mirror 6 designed to reflect the image of a person standing in front of it. The vertical panel 4 also has a rear face 42 that continues the rear face 52 of the support panel 5, which is tilted downward while being designed to be placed opposite the ground.

The angle delimited by the front face 41 of the vertical panel 4 and the front face of the display element 2 may be between 90° and 135°.

The vertical panel 4, which is substantially in the form of a rectangle, also has two lateral edges 43 and an upper edge 44 extending rearward and substantially defining a reinforcement. The support panel 5 also comprises lateral edges 53 and a front edge 54 that continue the display element 2.

The upper end 3*a* of the connecting element 3 also comprises a vertical bar 9 designed to be attached to the ceiling 8. This vertical bar 9 extends between a lower end secured to the upper edge 44 of the vertical panel 4 and an upper end provided with attachment means 7 comprising a first disk 10 secured to the vertical bar and a second disk 11 fixed to the ceiling 8. The first disk 10 is supported by the second disk 11 while being rotatably mounted relative to the latter. Nevertheless, provision may also be made for the attachment means 7 solely to enable the connecting element 3 to be attached to the ceiling 8 without allowing pivoting of said connecting element 3 relative to the ceiling 8 about a vertical axis. In such a case, the vertical bar 9 or, more precisely, its upper end, may be attached directly to the first disk 10, which will be fixed directly to the ceiling 8.

The attachment means 7 enabling the connecting element 3 to be suspended from the ceiling 8 may also be at least partially masked by a false ceiling 8*a* defining a compartment at least partially containing the vertical bar 9 and the first and second disks 10 and 11, this false ceiling 8*a* being fixed directly to the ceiling 8.

According to another characteristic of the invention, the rear and vertical face 42 of the vertical panel 4 and also the downward-tilted rear face 52 of the support panel 5 may be provided with a plurality of lighting systems 12 formed, for example, by neon lights arranged at regular intervals. These lighting systems 12 will be powered electrically via electrical connections passing, for example, inside the vertical bar, 9 and connected to an electrical power supply arranged in the ceiling 8 of the room.

These lighting systems 12 are covered by at least one cover 13 having shapes that substantially complement those of the vertical panel 4 and of the support panel 5. More precisely, this cover 13 comprises a rear plate 13*a* extending vertically opposite the rear face 42 of the vertical panel 4. This rear plate 13*a* of the cover 13 extends via a downward-tilted plate 13*c* that is parallel to the support panel 5. The cover 13 also comprises lateral edges 13*b* extending forward and engaging, respectively, with the lateral edges 43 and 53 of the vertical 4 and support 5 panels and with the upper edge 44 of the vertical panel 4 and with the front edge 54 of the support panel 5.

This cover 13 is produced in a substantially translucent material to allow diffuse lighting both to the rear of the counter display, via the rear part 13*a* of the cover, and on the sides, via the transverse edges 13*b* of said cover 13, but also toward the bottom, in the direction of the ground, via the downward-tilted plate 13*c*.

The arrangement of the lighting systems 12 on the rear face of the connecting element 3 and the presence of the translucent cover 13 thus, by reflection of the light on the direct environment of the counter display, make it possible to obtain diffuse lighting for the person standing directly in front of the mirror 6 and the display element 2 for the articles.

Figure 4:
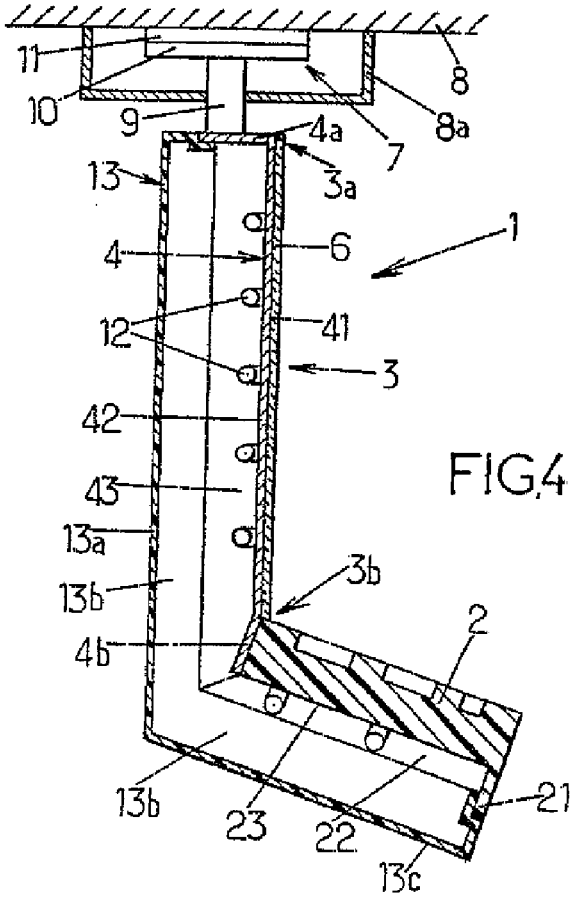
FIG. 4 is a sectional view in the plane of symmetry of the counter display according to a second embodiment of the invention.

FIG. 4 shows a second embodiment of the invention.

In this second embodiment, the connecting element 3 is formed solely by the vertical panel 4 that extends between the upper end 4*a* and the lower end 4*b* combined with the lower end 3*b* of said connecting element. The display element 2 for the articles itself is fixed directly to the lower end 4*b* of the vertical panel 4 of the connecting element 3.

The display element 2 also has a front edge 21 and also lateral edges 22 that continue the lateral edges 43 of the vertical panel 4 so as to define a reinforcement in which the lighting devices 12 are fitted. More particularly, these lighting devices 12 are attached to the rear face 42 of the vertical panel 4 and to the rear face 23 of the display element 2 that is tilted downward while being designed to be arranged facing the ground.

Furthermore, the vertical bar 9 and the attachment means 7 allowing the connecting element 3 to be suspended from the ceiling 8 are identical to those described previously in respect of the first embodiment shown in FIGS. 1 to 3.

Similarly, the cover 13 designed to cover the rear part of the counter display is also identical to that described previously apart from the fact that the lateral edges 13*b* of said cover interact directly with the lateral edges 22 of the display element 2 and with the lateral edges 43 of the vertical panel 4.

The invention claimed is:

1. A counter display for articles such as perfumes or cosmetic products adapted to be suspended from a ceiling, the display comprising:

a connecting element including a rigid vertical panel extending between a lower end and an upper end;

a rigid support panel having at least a display element configured to support the articles, the support panel being rigidly coupled to the lower end of the vertical panel and extending the vertical panel downward and forward, the support panel being tilted downward relative to the vertical panel at an angle of less than 135°;

a rigid pivot structure having a first end coupled to the vertical panel upper end and a second end coupled to the ceiling, wherein the pivot structure first end and the vertical panel are rotatable relative to the pivot structure second end around only a vertical pivot axis without any other freedom of movement, thereby suspending said display element from the ceiling with no contact with the ground; and a mirror attached to said vertical panel, said mirror being arranged such that a person standing in front of the display element can observe his/her image in said mirror.

2. The counter display as claimed in claim 1, wherein the connecting element has, first, a front face to which the mirror is attached and, second, a rear face to which a lighting system is attached.

3. The counter display as claimed in claim 1, wherein the support panel has a rear face opposite the mirror and said counter display has a lower face tilted downward under the display element, said rear face and lower face having lighting systems attached thereto and said lighting systems are covered by at least one substantially translucent cover that allows diffuse lighting toward the rear and toward the bottom of said counter display.

4. The counter display as claimed in claim 1, wherein the vertical panel extends downward via the display element.

5. The counter display as claimed in claim 4, wherein the vertical panel of the connecting element and the display element respectively have a rear face and a face tilted downward, to which faces lighting systems are attached, which are covered by at least one substantially translucent cover allowing diffuse lighting toward the rear and toward the bottom of said counter display.

6. The counter display as claimed in claim 3, wherein the cover comprises a rear plate extending via a plate tilted downward and transverse edges that link the rear plate and the plate tilted downward to the counter display in order, also, to allow lighting on the sides of said counter display.

7. The counter display as claimed in claim 1, wherein the upper end of the connecting element is formed by a bar provided with means for attachment to the ceiling, which allow pivoting of said bar relative to the ceiling about a vertical axis.

8. The counter display as claimed in claim 1, wherein said mirror is flat.

* * * * *